US005966739A

United States Patent [19]

Wagner

[11] Patent Number: 5,966,739

[45] Date of Patent: Oct. 19, 1999

[54] GOALIE PANTS WITH TELESCOPIC PADDING

[75] Inventor: Steve Wagner, Waterloo, Canada

[73] Assignee: Bauer Nike Hockey Inc., Montreal, Canada

[21] Appl. No.: 09/119,396

[22] Filed: Jul. 21, 1998

Related U.S. Application Data

[60] Provisional application No. 60/053,233, Jul. 21, 1997.

[51] Int. Cl.[6] ..... A41D 13/00; A41D 1/06; B63B 71/12

[52] U.S. Cl. ..... 2/23; 2/464; 2/466; 2/235

[58] Field of Search ..... 2/455, 464, 466, 2/22, 23, 24, 79, 235, 236, 238, 237, 228

[56] References Cited

U.S. PATENT DOCUMENTS

| | | |
|---|---|---|
| 417,450 | 12/1889 | Van Duzer . |
| 759,765 | 5/1904 | Stall . |
| 759,833 | 5/1904 | Stall . |
| 841,514 | 1/1907 | Halligan . |
| 851,930 | 1/1907 | Greenberger . |
| 1,641,733 | 9/1927 | Bullock . |
| 2,629,094 | 2/1953 | Goldsmith . |
| 3,484,868 | 12/1969 | Davenport . |
| 3,787,892 | 1/1974 | Quinn . |
| 4,325,148 | 4/1982 | Livernois . |
| 4,577,346 | 3/1986 | Hall . |
| 5,365,610 | 11/1994 | Lubahn et al. . |

*Primary Examiner*—John J. Calvert
*Assistant Examiner*—Shirra L. Jenkins
*Attorney, Agent, or Firm*—Finnegan, Henderson, Farabow, Garrett & Dunner, L.L.P.

[57] ABSTRACT

Goalie pants provided with a space within the pants in which the upper protective pad of the goalie can be received. This space enables the goalie to freely move without causing any bunching of the upper pad or the pants that may lead to a lack of comfort. A second innovative feature of the improved goalie pants resides in the provision of overlapping thigh and knee padding elements that can move between a retracted and an extended position. In the extended position, the thigh and the knee padding elements are arranged such that they provide a continuous protection of the thigh and the knee. The overlapping relationship between the knee and the thigh padding elements allow them to retract when the goalie is in a position such that other protective equipment (such as the pads covering the legs) interferes with the goalie pants. A third innovative feature resides in the provision of a groin padding element that is mounted on the outside of the pants and forms a flap that overlaps the thigh padding element. This structure allows the groin padding element to smoothly slide over the thigh padding element when the goalie kneels on the ice.

11 Claims, 5 Drawing Sheets

GOALIE PANTS WITH TELESCOPIC PADDING

This Appln claims benefit of Provisional Appln. No. 60/053,233 filed Jul. 21, 1997.

FIELD OF THE INVENTION

The present invention relates to the art of manufacturing protective equipment and more particularly to improved goalie pants for use in ice hockey games, that offers enhanced protection against puck impacts while also offering improved comfort.

BACKGROUND OF THE INVENTION

In known types of goalie pants, the configuration of the padding either provides poor flexibility, which limits the goaltender's ability, or poor protection against impacts, which may lead to severe injuries, due to the lack of protection. Both situations penalize the goaltender.

Thus, there is a need in the industry for goalie pants with improved comfort and protection.

OBJECTS AND STATEMENT OF THE INVENTION

An object of the invention is to provide goalie pants with a padding arrangement adaptable to the different positions of a goaltender during a hockey game.

Another object of the invention is to provide goalie pants with limited interference between the upper body pad and the pants.

As embodied and broadly described herein, the invention provides goalie pants for a goaltender comprising two sleeve-like elements for covering the upper part of the wearer's legs, a waist portion for covering the waist of the wearer and to which said sleeve-like members are connected, said waist portion including a rear portion adapted to face the back of the wearer, side portions extending laterally from said rear portion and a frontal portion extending down partly between the sleeve-like elements for covering the groin area of the wearer, said pants comprising padding material to protect the wearer against impacts, said waist portion including a belt connected to the internal face of the waist portion, said belt extending from said rear portion to said lateral portions, and defining in the upper frontal portion a pad receiving area for receiving additional padding, said area being provided with fastening members adapted for fastening said belt. This space enables the goalie to freely move without causing any bunching of the upper pad or the pants that may lead to a lack of comfort.

Preferably, the rear portion of the belt is integrally connected to the rear portion of the waist portion, said side portions being connected to said rear portion of the belt, said side of the belt portions being separate from side portions of the waist of the pant. These arrangements provide enhanced comfort in the area of the interface between the upper body pad and the pants.

As embodied and broadly described herein, the invention also provides goalie pants for a goaltender comprising two sleeve-like elements for covering the upper part of the wearer's legs, a waist portion for covering the waist of the wearer and to which said sleeve-like members are connected, said waist portion including a rear portion adapted to face the back of the wearer, side portions extending laterally from said rear portion and a frontal portion extending down partly between the sleeve-like elements for covering the groin area of the wearer, said pants comprising padding material to protect the wearer against impacts, wherein said sleeve-like elements being provided with a frontal telescopic padding arrangement, said arrangement comprising a plurality of padding elements and being adapted to provide a telescopic movement between an extended position corresponding to a substantially bent knees position of the wearer, and a retracted position corresponding to a substantially upright position of the wearer, in said extended position, said padding elements substantially extend one after the other, in said retracted position, said padding elements substantially extend with overlapping portions. Such an arrangement provides a continuous protection all along to the upper legs of the wearer, independently of the legs position. The provision of overlapping thigh and knee padding elements that can move between a retracted and an extended position is of particular interest. In the extended position, the thigh and the knee padding elements are arranged such that they provide a continuous protection of the thigh and the knee. The overlapping relationship between the knee and the thigh padding elements allow them to retract when the goalie is in a position such that other protective equipment (such as the pads covering the legs) interferes with the goalie pants.

Advantageously, the telescopic padding arrangement comprises an upper thigh padding element and a lower thigh padding element slidingly mounted to the rear portion of said upper thigh padding element. This provides a simple, cost effective and reliable arrangement to ensure a full protection for the wearer.

The telescopic padding arrangement preferably further comprises a knee padding element, slidingly mounted to the rear portion of said lower thigh element.

The telescopic padding arrangement preferably further comprises flexible envelopes adapted to enclose the padding elements.

Advantageously, the goalie pants further comprise a pair of groin pads, slidingly overlapping said sleeve-like members. This structure allows the groin padding element to smoothly slide over the thigh padding element when the goalie kneels on the ice.

BRIEF DESCRIPTION OF THE DRAWINGS

The goalie pants in accordance with the present invention offer a number of innovative features that contribute to the overall objective of improved comfort and protection. The structure of the novel goalie pants is illustrated in FIGS. 1 to 7 of the annexed drawings. More specifically, in those drawings.

Figure 1:
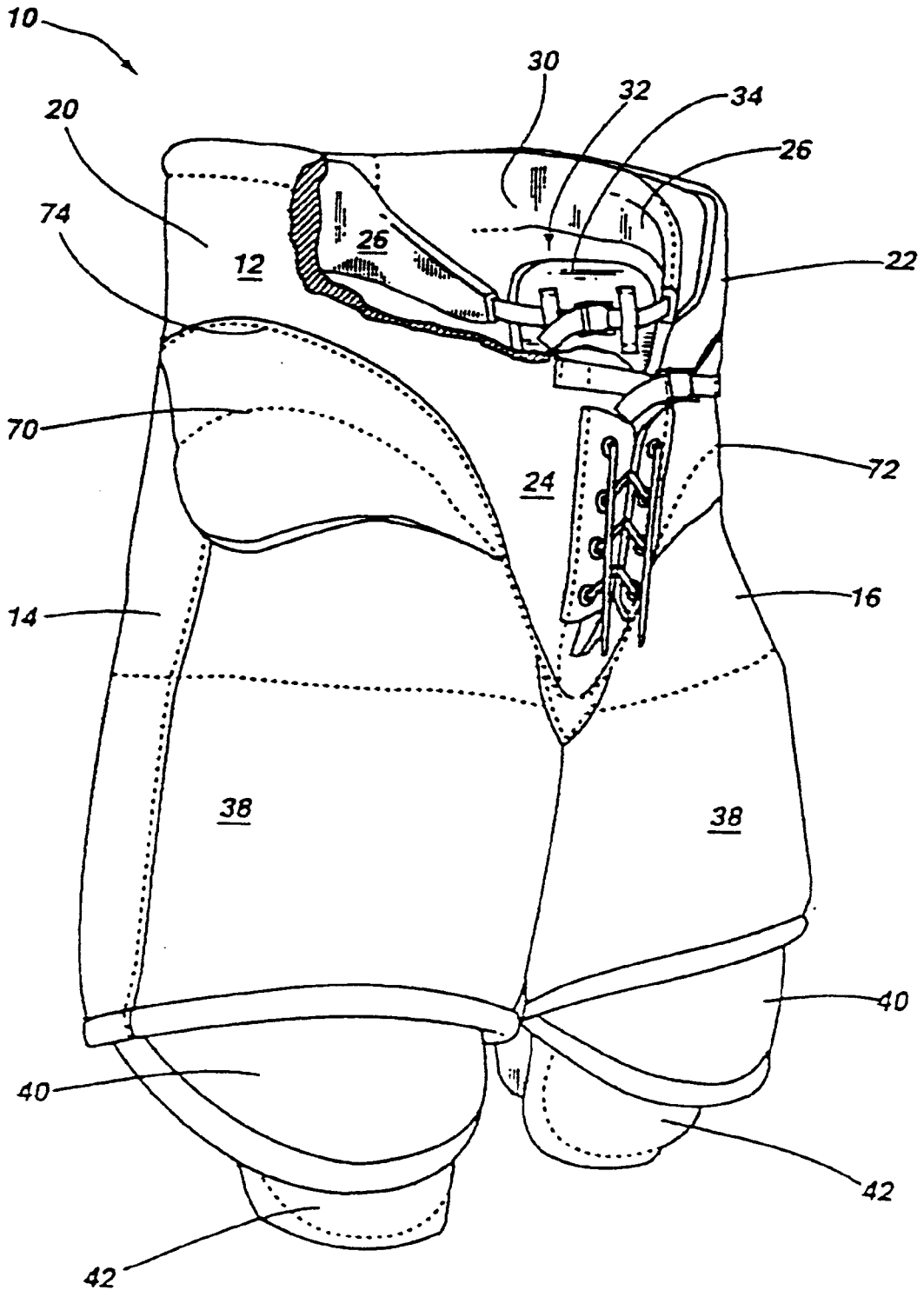
FIG. 1 is a perspective view, illustrating the goalie pants according to the invention.

In the drawings, preferred embodiments of the invention are illustrated by way of examples. It is to be expressly understood that the description and drawings are only for the purpose of illustration and are an aid for understanding. They are note intended to be a definition of the limits of the invention.

DETAILED DESCRIPTION OF PREFERRED EMBODIMENTS

Figure 2:
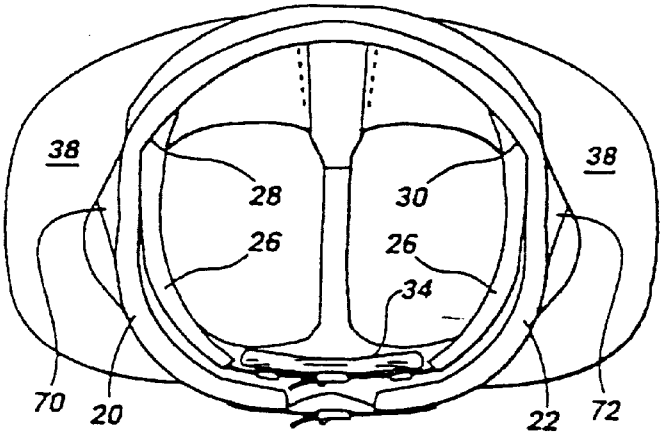
FIG. 2 is a top view of the pants in FIG. 1.
Figure 3:
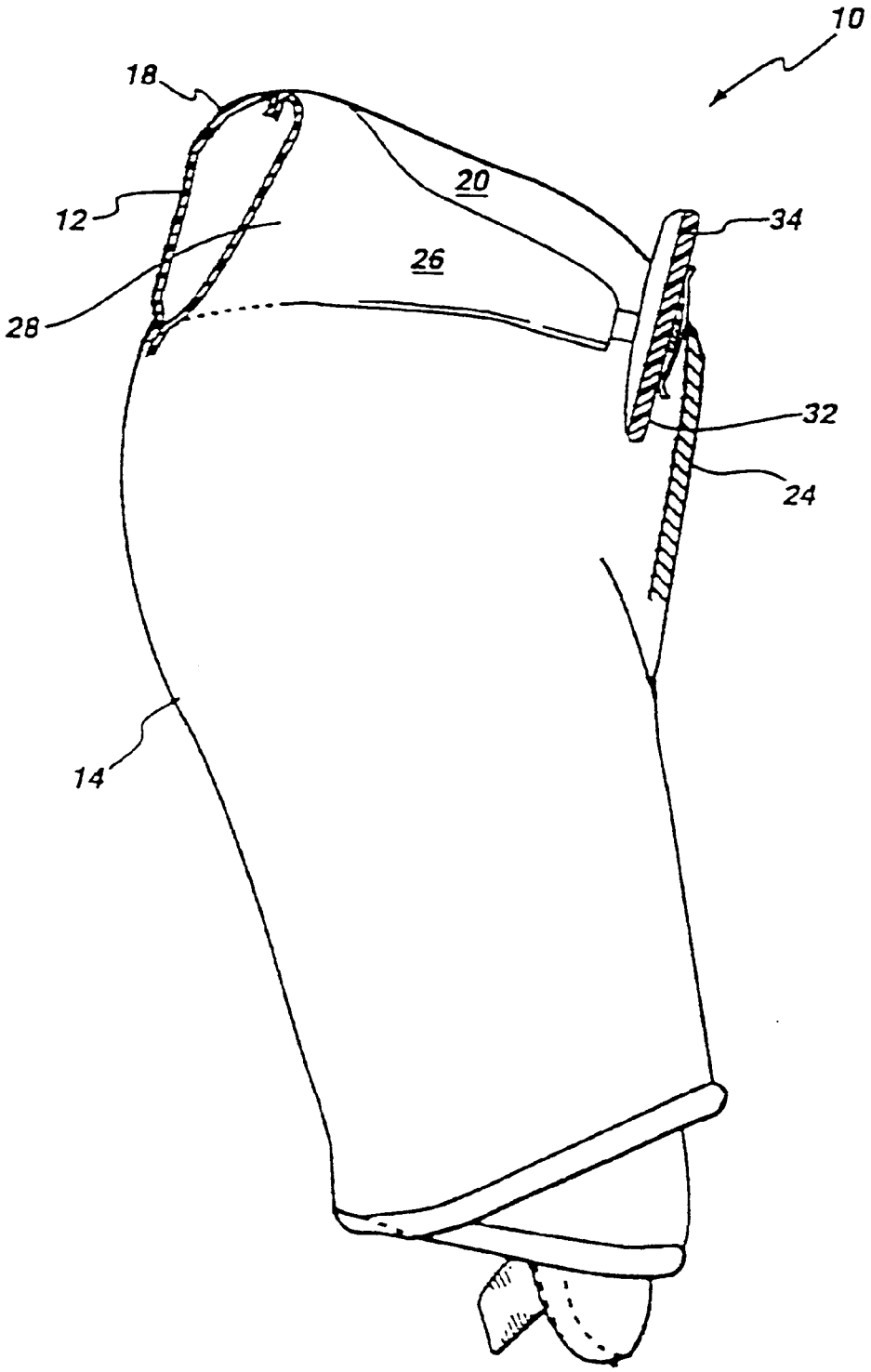
FIG. 3 is a side elevational, partly fragmentary view of the novel goalie pants, illustrating the location of the belt that provides a space for receiving an upper body pad.

With reference to FIGS. 1, 2 and 3 of the annexed drawings, the novel goalie pants are designated comprehensive by the reference numeral 10 and includes three major components, namely a waist portion 12 that merges with a pair of sleeve-like elements 14 and 16 that receive the thighs and the knees of the wearer. The waist portion 12 is designed to completely encircle the waist of the wearer to provide protection in that area against puck impacts. More specifically, the waist portion includes a rear section 18 that faces the back of the wearer, sides portions 20 and 22, and a frontal portion 24 that extends down partly between the sleeve-like elements to cover the groin area of the user. The waist portion 12 includes a sufficient amount of padding material to absorb the energy of puck impacts and thus protect the body of the user. In a typical configuration, the waist portion 12 includes an outer structure or shell made of fabric or any other flexible material that defines an envelope in which the padding is inserted. In the particular form of construction depicted at FIG. 1, the padding material is in the form of a belt that extends all around the waist of the user. The padding may be made of synthetic foam or from any other suitable material that can provide the desired level of impact absorption.

To hold the goalie pants on the user and preventing them to fall, the waist portion 12 is provided with a belt 26. The belt is secured on the internal face of the waist portion and in use contacts the underwear of the user. A characterizing element of the belt placement is that the belt separates from the inner surface of the waist portion at sites 28 and 30. The sites 28 and 30 are located approximately at mid-point of the respective side portions of the waist portion. This configuration results in the formation of an empty space or zone 32 that is defined between the belt and the front portion of the waist portion. The empty space 32 is dimensioned to receive the lower portion of the upper goalie pad 34. This feature thus enables to establish a free fit between the goalie pad and the pants that prevents the pants and the pad from bunching while maintaining a sufficient level of protection.

In use, when the user places the pants on his body, the belt 26 is tightened in place by adjusting a suitable buckle or a similar device. The adjustment is performed such that the belt snugly fits and encircles the waist of the user. In this condition, the frontal part of the waist portion projects outwardly and defines the empty space 32 that can receive the lower part of the upper pad 34. When the user moves his torso forward or backward (FIG. 1 shows the typical upright posture that the goalie will adopt) the lower part of the upper body pad 34 can move up and down in the space 32. This prevents interference and bunching between the pants and the goalie pad. At the same time, the goalie pants are securely retained against the user's body so they will not fall or loosen up. The insertion of the lower part of the goalie pad 34 in the space 32 creates an overlapping relationship with the frontal waist portion that, due to the doubling of the padding material in that area, and enhances the ability of the structure to absorb the energy of puck impacts.

The belt 26 can be retained against the inner face of the waist portion by any suitable means, such as by stitching, adhesives or other possible fasteners that are normally used in the garment industry.

In a variant, a front pad 34 may be provided in the area 32. This front pad is advantageously attached to the inner portion of the belt as shown in FIG. 1.

Figure 4:
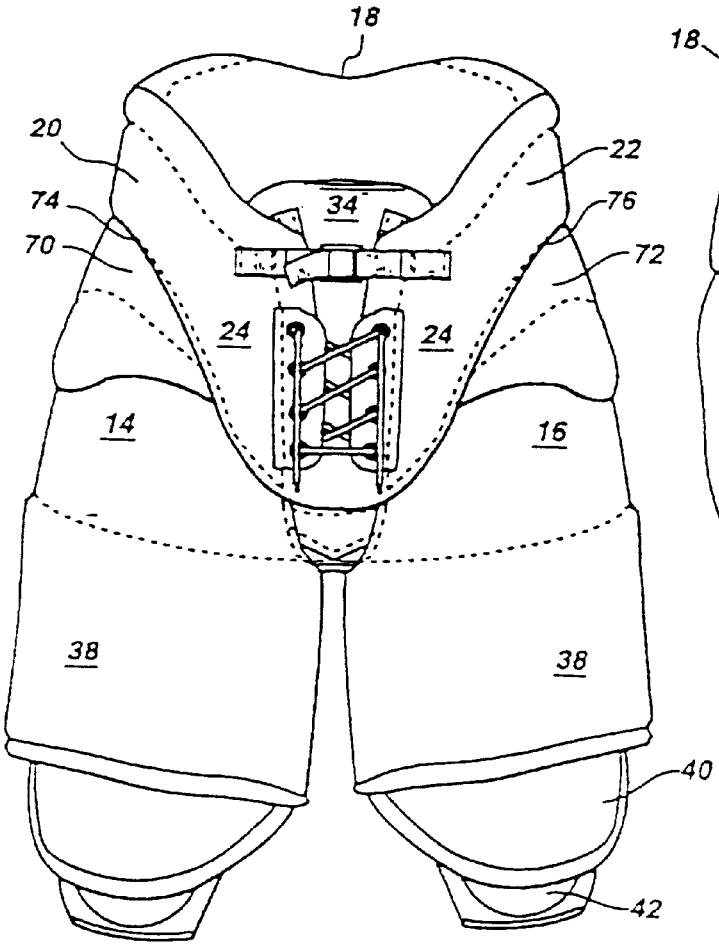
FIG. 4 is a front elevational view of the goalie pants, illustrating the location of the groin pad and telescopic padding arrangements.
Figure 5:
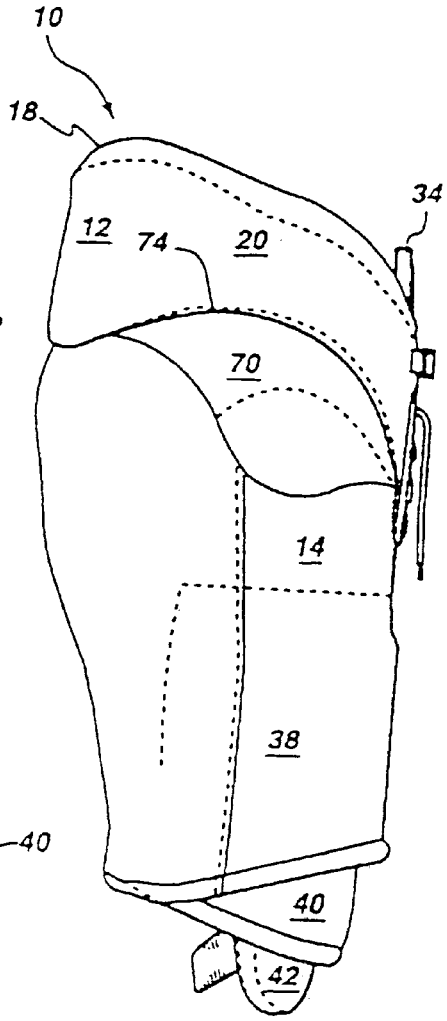
FIG. 5 is a side elevational view of the goalie pants depicted in FIG. 4.
Figure 7:
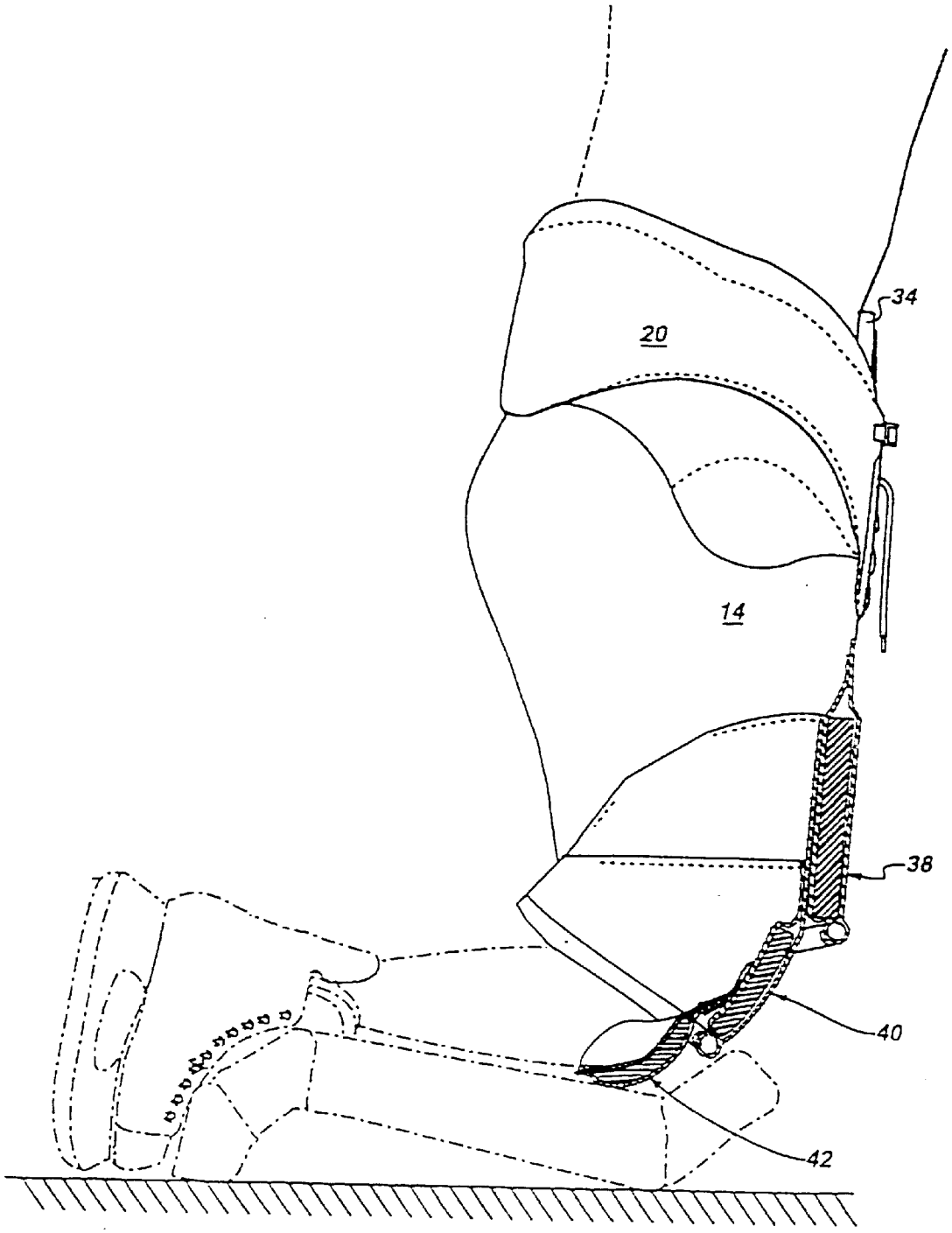
FIG. 7 is similar to FIG. 6, showing the position acquired by the various padding elements when the knee of the goalie is bent.

FIGS. 4 and 7 illustrate the construction of the sleeve-like members 14 and 16. For convenience, only the structure of the sleeve-like member 16 will be described herein, it being understood that the structure of the companion sleeve-like member 14 is identical. The main feature of the sleeve-like member 16 resides in the provision of a collapsible thigh/knee padding structure that is designed to provide an excellent protection against puck impacts while, at the same time, be comfortable to wear. Generally speaking, the thigh/knee padding structure includes a plurality of padding elements that overlap one another. When the goalie is standing upright, those padding elements acquire a somewhat collapsed condition due to interference with the pads that protect the legs (the upper ends of the pads urge the thigh/knee padding structure to collapse). When the user bends his knee, as depicted in FIG. 7, the overlapping padding elements extend by sliding relative to one another so as to expand the vertical dimension of the sleeve-like member and thus provide full coverage of the thigh and knee. This characteristic provides a dynamic adaptability of the sleeve-like member, reducing its length when necessary, particularly when protective equipment interferes with the goalie pants, while automatically extending the sleeve-like member when such interference is discontinued.

More specifically, the sleeve-like element 16 comprises three independently movable padding elements, namely an upper thigh padding element 38, a lower thigh padding element 40, and a knee padding element 42.

Figure 6:
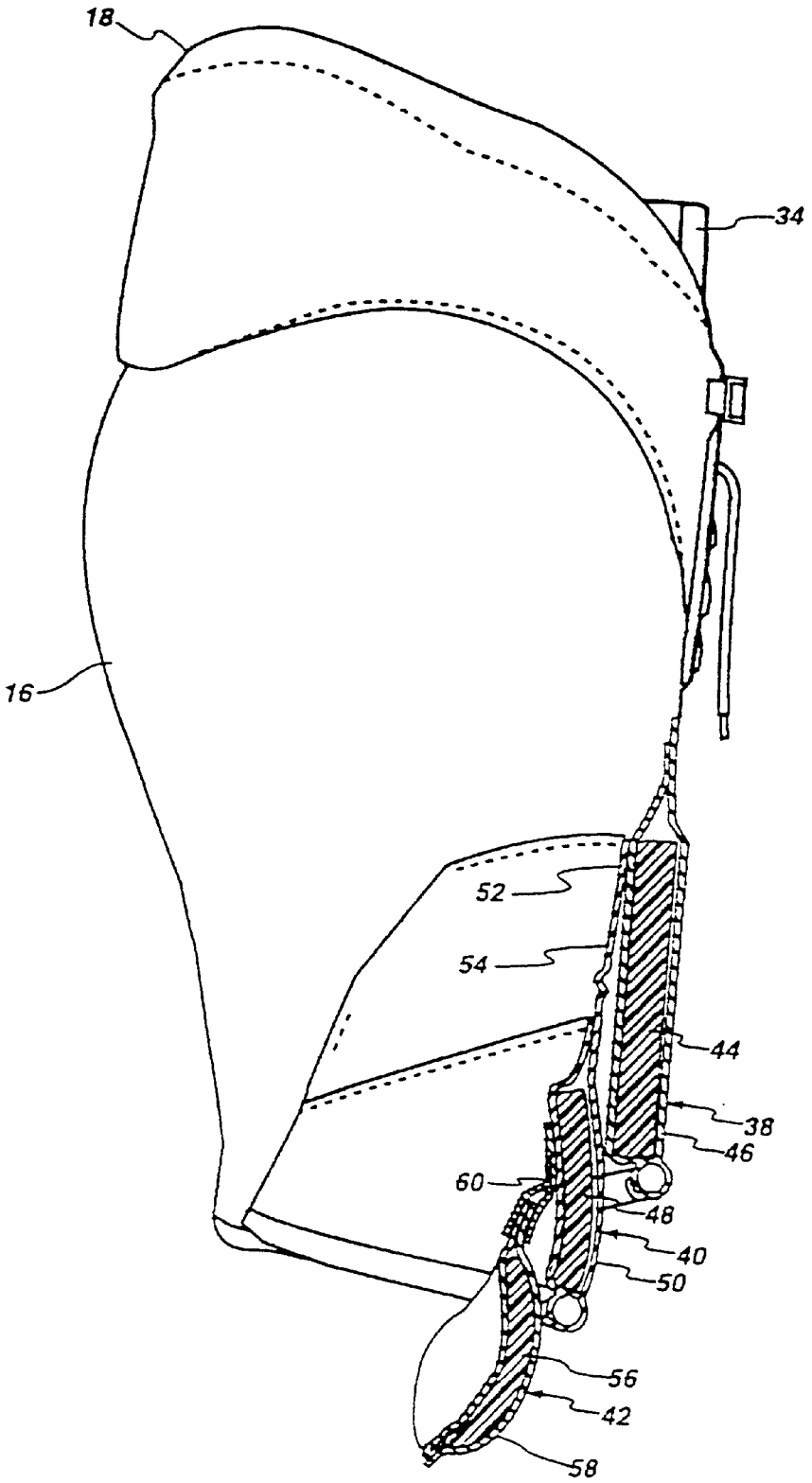
FIG. 6 is a side elevational view of the goalie pants, some parts being shown in cross-section to illustrate the structure of the thigh and knee padding.

As best shown at FIG. 6, the upper thigh padding element 38 includes an arcuate shaped piece of padding material 44 (to conform to the curvature of the thigh), made of synthetic foam or any other suitable energy absorption material that is enclosed into a flexible envelope 46 made of fabric or of any other suitable material, that essentially positions the padding material 44 against the frontal part of the upper thigh of the user.

The lower thigh padding element 40 is similarly constructed. More specifically, it includes a strip of protective material 48 contained in an envelope or pocket 50, the upper extremity of the pocket is stitched or otherwise retained at site 52 that is near the upper edge of the strip of protective material 44. The portion 54 of this envelope constitutes a flexible membrane that allows the lower thigh padding element 40 to move up, behind the upper thigh padding element, so as to provide the collapsing movement earlier described. In the position depicted at FIG. 7, the portion 54 is fully extended and no longer authorizes a downward movement of the lower thigh padding element. The length of this flexible membrane is selected such that in a position of full extension, some residual degree of overlap between the strips of padding material remains. This has been found to provide good protection against puck impacts.

A similar arrangement is used for the construction of the knee padding element 42. A strip of padding material 56, that may be of rounded shape to adapt itself to the shape of the human knee, is enclosed in a flexible pocket 58 that is secured at some point to the inner face of the pocket 50 that belongs to the lower thigh padding element. The flexible membrane 60 allows the knee padding element to slide behind the lower thigh padding element so as to controllably collapse the protective structure. As in the case of the lower thigh padding element, the length of the flexible membrane 60 determines the degree at which the knee padding element can project downwardly from the lower edge of the lower thigh padding element. Here too, some degree of overlap between the padding elements is preferred in order to maintain good protection.

Yet another innovative feature of the goalie pants in accordance with the invention is depicted at FIG. 4. This feature resides in the provision of a pair of groin pads 70 and 72 that overlap the sleeve-like members. This structure permits good protection in the groin area of the body without unduly restricting body movements. More specifically, each groin pad, either pad 70 or pad 72, includes a layer of suitable energy absorbing padding material (not shown in-the drawings) that is placed in a flexible pouch and stitched along the base of the waist portion. In FIG. 4, the groin pad 70 will thus be retained to the goalie pants along a line of juncture 74. Similarly, the groin pad 72 is retained to the goalie pants at the line of juncture 76. Thus, in use, the groin pads hang freely and overlap the upper thigh padding elements of the respective sleeve-like members. Thus, when the user bends the torso forward, the groin pads are free to slide on the outer surface of the upper thigh padding elements so as to prevent bunching and discomfort. At the same time, the protection at that area is maintained adequately.

The above description of preferred embodiments should not be interpreted in any limiting manner since these variations, modifications and refinements are possible within the spirit and scope of the invention. The scope of the invention is defined in the appended claims and their equivalents.

What is claimed is:

1. Padded goalie pants comprising:

a waist portion for covering a wearer's waist having a rear portion, two side portions extending laterally from the rear portion, and a front portion extending downwardly from the waist portion for covering the wearer's groin area;

two sleeve-like elements connected to the waist portion for covering the upper part of the wearer's legs;

a belt, connected internally to the waist portion, having two ends that define a pad receiving area in an upper region behind the front portion; and a fastener provided on the belt ends so that the ends may be fastened together.

2. The padded goalie pants of claim 2, wherein the belt is connected to the rear portion and extends, unconnected to the waist portion, to a position behind the front portion.

3. The padded goalie pants of claim 1, further comprising:

a front pad connected to the belt in the pad receiving area.

4. Padded goalie pants comprising:

a waist portion for covering a wearer's waist having a rear portion, two side portions extending laterally from the rear portion, and a front portion extending downwardly from the waist portion for covering the wearer's groin area;

two sleeve-like elements connected to the waist portion for covering the upper part of the wearer's legs;

a telescopic padding arrangement provided at the front of each of the sleeve-like elements having a plurality of padding elements telescopically moveable between an extended position, when the wearer kneels, and a retracted position, when the wearer is substantially upright, the plurality of padding elements overlapping one another in the retracted position and any position between the extended position and the retracted position;

a belt, connected internally to the waist portion, having two ends that define a pad receiving area in an upper region behind the front portion; and a fastener provided on the belt ends s1 that the ends may be fastened together.

5. The padded goalie pants of claim 4, wherein the telescopic padding arrangement comprises:

an upper thigh padding element; and a lower thigh padding element slidingly mounted to a rear portion of the upper thigh padding element.

6. The padded goalie pants of claim 5, wherein the telescopic padding arrangement further comprises:

flexible envelopes enclosing the upper and lower thigh padding elements.

7. The padded goalie pants of claim 5, further comprising:

a knee padding element slidingly mounted to a rear portion of the lower thigh padding element.

8. The padded goalie pants of claim 7, further comprising:

flexible envelopes enclosing the upper thigh, lower thigh, and knee padding elements.

9. The padded goalie pants of claim 4, further comprising:

a pair of groin pads connected to the waist portion, slidingly overlapping the sleeve-like members.

10. The padded goalie pants of claim 4, wherein the belt is connected to the rear portion and extends, unconnected to the waist portion, to a position behind the front portion.

11. The padded goalie pants of claim 4, further comprising:

a front pad connected to the belt in the pad receiving area.

* * * * *

UNITED STATES PATENT AND TRADEMARK OFFICE

CERTIFICATE OF CORRECTION

PATENT NO. : 5,966,739
DATED : October 19, 1999
INVENTOR(S) : Steve Wagner

It is certified that error appears in the above-identified patent and that said Letters Patent is hereby corrected as shown below:

IN THE CLAIMS:

Claim 4, line 23, change "s1" to --so--.

Signed and Sealed this

Twenty-eighth Day of March, 2000

*Attest:*

Q. TODD DICKINSON

*Attesting Officer*

*Commissioner of Patents and Trademarks*